US006125718A

United States Patent [19]

Hill

[11] Patent Number: 6,125,718

[45] Date of Patent: Oct. 3, 2000

[54] AUTOMATIC JAR LID OPENER

[76] Inventor: James H. Hill, P.O. Box 1287, Searcy, Ark. 72145

[21] Appl. No.: 09/216,757

[22] Filed: Dec. 18, 1998

Related U.S. Application Data

[60] Provisional application No. 60/068,892, Dec. 29, 1997.

[51] Int. Cl.[7] ..... B67B 7/00

[52] U.S. Cl. ..... 81/3.2

[58] Field of Search ..... 81/3.2, 3.32, 3.39

[56] References Cited

U.S. PATENT DOCUMENTS

| | | | |
|---|---|---|---|
| 3,812,742 | 5/1974 | Polasek . | |
| 3,950,801 | 4/1976 | Morrison . | |
| 4,102,226 | 7/1978 | McGuire | 81/3.32 X |
| 5,353,665 | 10/1994 | Heebner . | |
| 5,370,019 | 12/1994 | Sartell et al. . | |
| 5,430,923 | 7/1995 | Parent et al. . | |
| 5,617,765 | 4/1997 | Bennett . | |

*Primary Examiner*—James G. Smith
*Attorney, Agent, or Firm*—Stephen D. Carver

[57] ABSTRACT

An automatic, power-driven appliance loosens screw type lids from jars of varying sizes and shapes. A vertically upright housing is placed upon a flat, supporting surface like a counter-top or the like. The lower housing base as a frictional pad for engaging the jar. A spaced apart, movable head is constrained for vertical movements within the container chamber defined by the housing. The head is lowered or raised by a motor driving a lead-screw system. A rotatable friction chuck mounted in the head contacts and rotates the lid to be loosened. The friction chuck comprises a hollow drive shaft and means for shining Laser light through it to center a container to be opened. The start button should be pushed after centering a jar within the housing chamber, whereupon an automatic opening sequence commences.

16 Claims, 9 Drawing Sheets

AUTOMATIC JAR LID OPENER

CROSS REFERENCE TO RELATED APPLICATION

This application claims the benefit of the U.S. Provisional Patent Application Ser. No. 60/068,892, filed Dec. 29, 1997.

BACKGROUND OF THE INVENTION

I. Field of the Invention

The present invention relates generally to powered kitchen receptacle closure removers for kitchen use. More particularly, this invention relates to surface mounted jar lid openers of the type classified in United States patent Class 81, Subclasses 3.2, 3.25, and 3.32.

II. Description of the Prior Art

It has long been recognized by those skilled in the art that there are many instances where manual removal of a jar lid is either not desirable or not feasible. For example, a lid may be too tightly installed during the manufacturing process, making it difficult to remove. Fluid trapped between the lid and the jar may also cause the lid to stick in a tightened position.

Even when the effort required to open a lid is within generally accepted limits, some people may still be unable to accomplish this task. Individuals suffering from arthritis or other joint afflictions or diseases, the young or elderly, and persons suffering from arm or hand injuries are all examples of individuals who may need assistance in opening a jar.

Numerous machines for unscrewing lids from jars have been proposed in the prior art. For example, U.S. Pat. No. 3,812,742, issued to Emil Polasek on May 28, 1974, discloses a jar opener with a pair of manually operated lever arms that adjustably hold the jar from the sides. A motorized upper gripping device must be manually lowered by the operator until it comes into contact with the jar lid. The operator can then activate a switch which causes the motorized gripping device to rotate the lid. When the lid is loosened from the jar, the operator must activate the switch again to stop the rotation.

U.S. Pat. No. 3,950,801, issued to Howard J. Morrison on Apr. 20, 1976, and U.S. Pat. No. 5,370,019, issued to M. Kevin Sartell et al. on Dec. 6, 1994, disclose two more typical jar lid removing machines. These inventions provide a manually operated, vertical locking device holding the jar clamped between upper and lower gripping devices. The upper gripping device is lowered into contact with the jar lid and locked into position. The motorized drive means of the lower gripping device is then actuated, causing the jar to be rotated relative to the stationary position of the lid.

Although similar in concept to the Morrison and Sartell patents, U.S. Pat. No. 5,430,923, issued to Donald G. Parent et al. on Jul. 11, 1995, differs in that operation of the device is fully automated. After placing a jar between upper and lower gripping devices, the user activates a switch which causes the lower gripping device to rotate as the upper gripping device descends until coming into contact with the jar lid. Once the lid has been loosened, the upper gripping device automatically returns to its raised position and rotation of the lower gripping device is stopped.

U.S. Pat. No. 5,617,765, issued to Vivian A. Bennett on Apr. 8, 1997, discloses a jar lid opener with a stationary lower gripping platform and a rotatable upper gripping device. After placing a jar on the lower platform, the operator activates a switch which lowers the upper gripping device until it comes into contact with the jar lid, whereupon the operator must once again activate the switch to stop the downward movement. The operator then activates a second switch which causes the upper gripping device to rotate, thereby loosening the jar lid, and activates the second switch once again to stop the rotation. Finally, the first switch is once again activated to raise the upper gripping device to its original position.

Another automated jar lid opener is disclosed in U.S. Pat. No. 5,353,665, issued to William D. Heebner on Oct. 11, 1994. In one embodiment of Heebner's invention, a jar is placed upon a stationary lower gripping platform. Upon activating a switch, an upper gripping device descends until coming into contact with the jar lid, whereupon it begins to rotate and loosen the jar lid. Upon sufficient loosening of the lid, the upper gripping device automatically stops rotating and returns to its original raised position. A second embodiment of the invention is also disclosed whereby the jar is placed upon a rotatable lower gripping platform. Upon activation of a switch, an upper gripping device descends until coming into contact with the lid, and the lower platform rotates until the lid is loosened.

Although many different types of automated jar lid opening machines have been disclosed in the prior art, these devices suffer a variety of shortcomings. Many of these automated devices still require some degree of manual effort on the part of the operator, thereby negating their usefulness to individuals with limited physical abilities. Other of these devices require that the operator control both the stopping and starting of the motorized components. If the operator does not stop movement of the device at the proper time, excessive force might possibly be applied to the jar, thereby causing breakage. Those inventions which disclose clamping devices for holding a jar while the lid is being rotated oftentimes do not provide an even holding force. In some cases there is no way to regulate the amount of force being applied to the jar and it is conceivable that excessive pressure might be applied, thereby breaking the jar. In addition, many of these holding devices are further limited in that they cannot accommodate a wide range of sizes of jars.

Furthermore, many of the aforementioned problems characteristic of prior art jar opener devices are aggravated by problems relating to centering. If a jar is inserted into conventional rotary opening apparatus without proper centering, the eccentrically rotated jar will improperly engage the internal gripping mechanisms. Therefore a means for centering the jar is highly desirable.

SUMMARY OF THE INVENTION

My automatic jar opener is designed to open jars having lids approximately 0.5 to 4.5 inches in diameter. Typical jars range between 1.5 to 12 inches high and they may be up to six inches in diameter. Usually the apparatus would be stored on a countertop in the kitchen area. In operation a jar to be opened is set in the automatic portion, upon a base friction pad. A locator light switch activates the centering circuitry, which operates a laser beam to approximately center and align the jar within the apparatus. At this time a visible "spot" appears upon the lid, and aids in centering.

Once the jar is centered, the user withdraws his or her hands. The start button is then pushed to activate the power apparatus. At this time the head of the power unit descends until it contacts the jar lid. A friction chuck contacts the lid and grips it for removal. The chuck rotates and unscrews the lid about a half turn. Then the automatic head returns to the vertical position, at which time the now-opened jar may be easily removed by the user.

The start button is not functional until the laser beam has been turned on, thus preventing someone from accidentally pushing the start button and causing the head to prematurely descend.

A safety system comprising a hand-operated bar prevents injury or accident. Should the safety bar be moved vertically more than 1/16" after the laser beam has been turned on and the start button has been pushed, all movement of the jar lid opener will stop and the laser beam will be turned off. To restart the jar lid opener, or to elevate the head, it would first be necessary to turn on the laser beam.

Should the user see that the jar lid is not correctly centered or that the head should be stopped after the start button has been pushed and the head begins to descend toward the jar, the user should immediately push the "safety stop/reverse" button. This action will stop the descending head. Pushing the "safety stop/reverse" button a second time would cause the head to rise and return to the home position, and the laser beam would be turned off. However, with the head stopped, the user could reposition the jar so that the lid is centered with the laser beam or make any other necessary adjustments. After moving his or her hands to a safe area, the user could then push the start button again and the head would continue to descend, operating in a normal automatic cycle.

Known prior art jar openers are deficient in centering. They do not properly address the need to center the jar lid with the axis of the rotating members, such as the chuck or jar rotator.

Thus a basic object of the invention is to provide a powered jar opener.

Another object is to provide a powered jar lid opener of the character described that provides a physical footprint sized about the same as a common kitchen toaster.

A similar object is to provide a lid loosening appliance of the character described that aids in the centering of the candidate jar to be opened.

Another object is to produce a powered jar opener of the character described that forcibly opens jars without destroying them.

An important object is to provide a jar opener of the character described that is safe and avoids injury.

Still another object is to provide a jar opener of the character described that handles a wide variety of jar sizes and shapes.

Yet another object is to provide a housing that is both cosmetically appealing and utilitarian.

Still another object is to provide safety apparatus in an appliance of the character described that prevents it from starting inadvertently.

Another basic object is to provide an appliance of the character described that enables the elderly, invalids, the handicapped, and other persons with temporary or permanent disabilities to open jars with tightly attached lids.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The preferred jar opener comprises a vertically upright housing 10 adapted to be disposed upon a counter top or the like. The preferably molded plastic housing defines a jar chamber 16 in which a jar to be opened is inserted. The base 12, head 14, and vertical side members 11A, 11B surround the jar chamber 16. Base 12 functions as a platform, on which to set a jar that is to be opened. In addition, base 12 also houses an electric drive motor and gearing that lowers and/or raises the head by rotating two synchronized; vertically positioned, parallel locator (lead) screws. The head is attached to these lead screws by means of threaded bushings.

Figure 3:
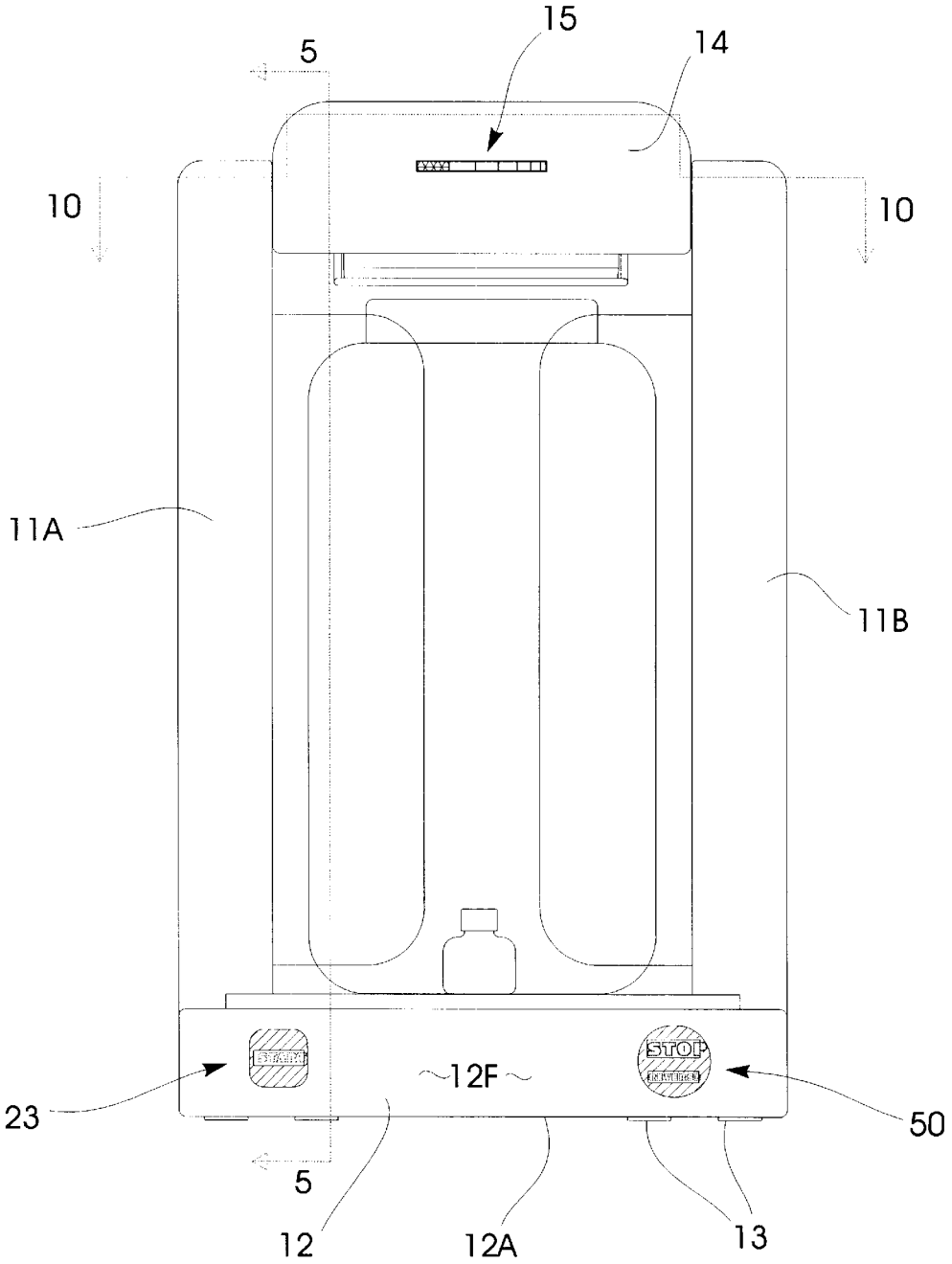
FIG. 3 is a front plan view with the head in a raised position.

The base 12 comprises the lowermost portion of the housing 10. The undersurface 12A (FIG. 3) of the base has four short legs 13 that allow the jar opener to be positioned upright, on a kitchen countertop, or similar flat surface. A resilient friction pad 17 is secured to base 12 to prevent a jar from turning during opening. The friction pad is constructed from a highly frictional, commercially available material such as silicone rubber. Preferably the vertical side members 11A, 11B are integral with the base, molded as a single unit. Alternatively they may comprise separate pieces fastened by screws or the like. A start button 23 and a safety stop/reverse button 50 are located on the lower front face 12F of the base for operator convenience.

Figure 4:
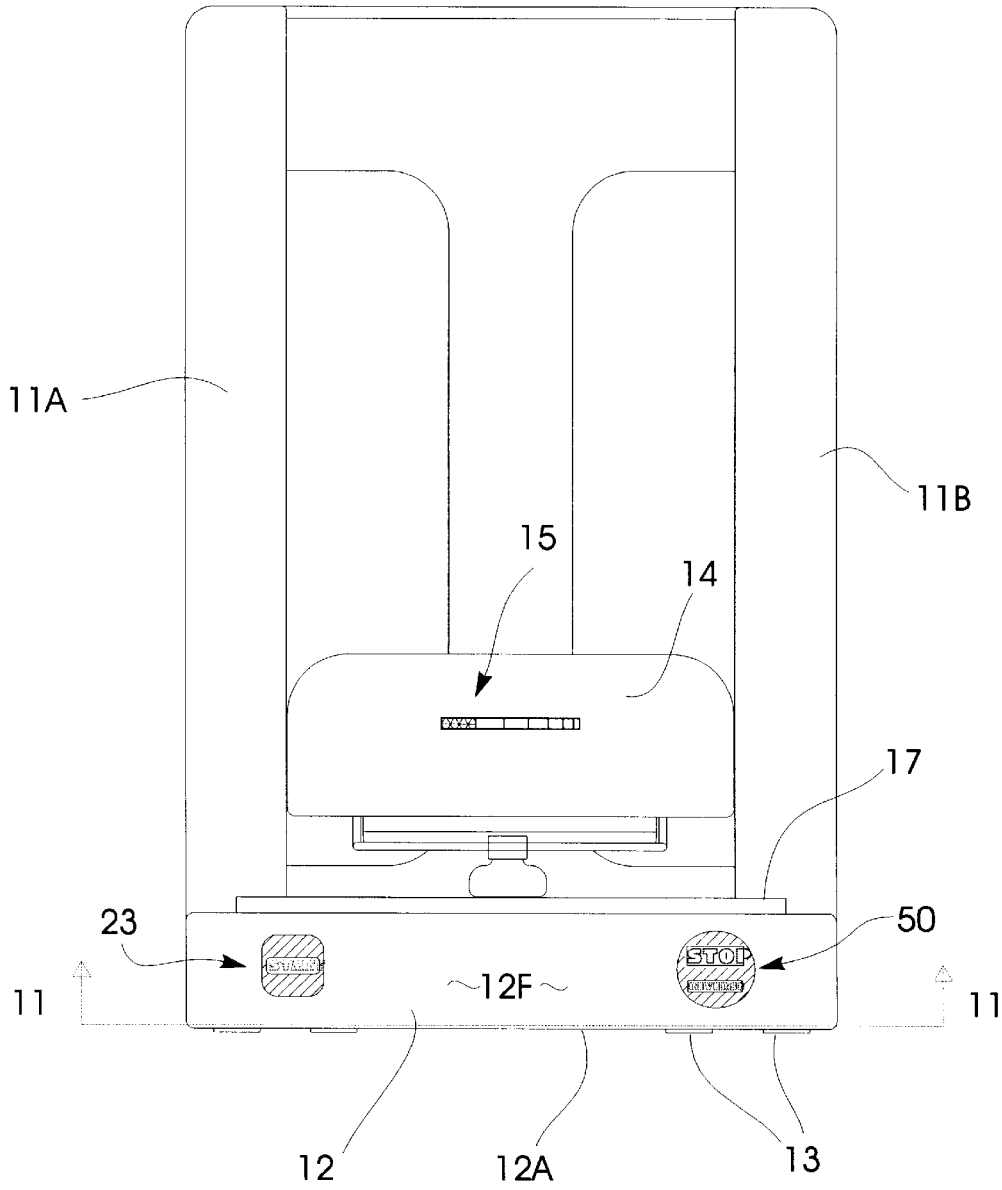
FIG. 4 is a view similar to FIG. 3, with the head lowered to a minimal height.
Figure 10:
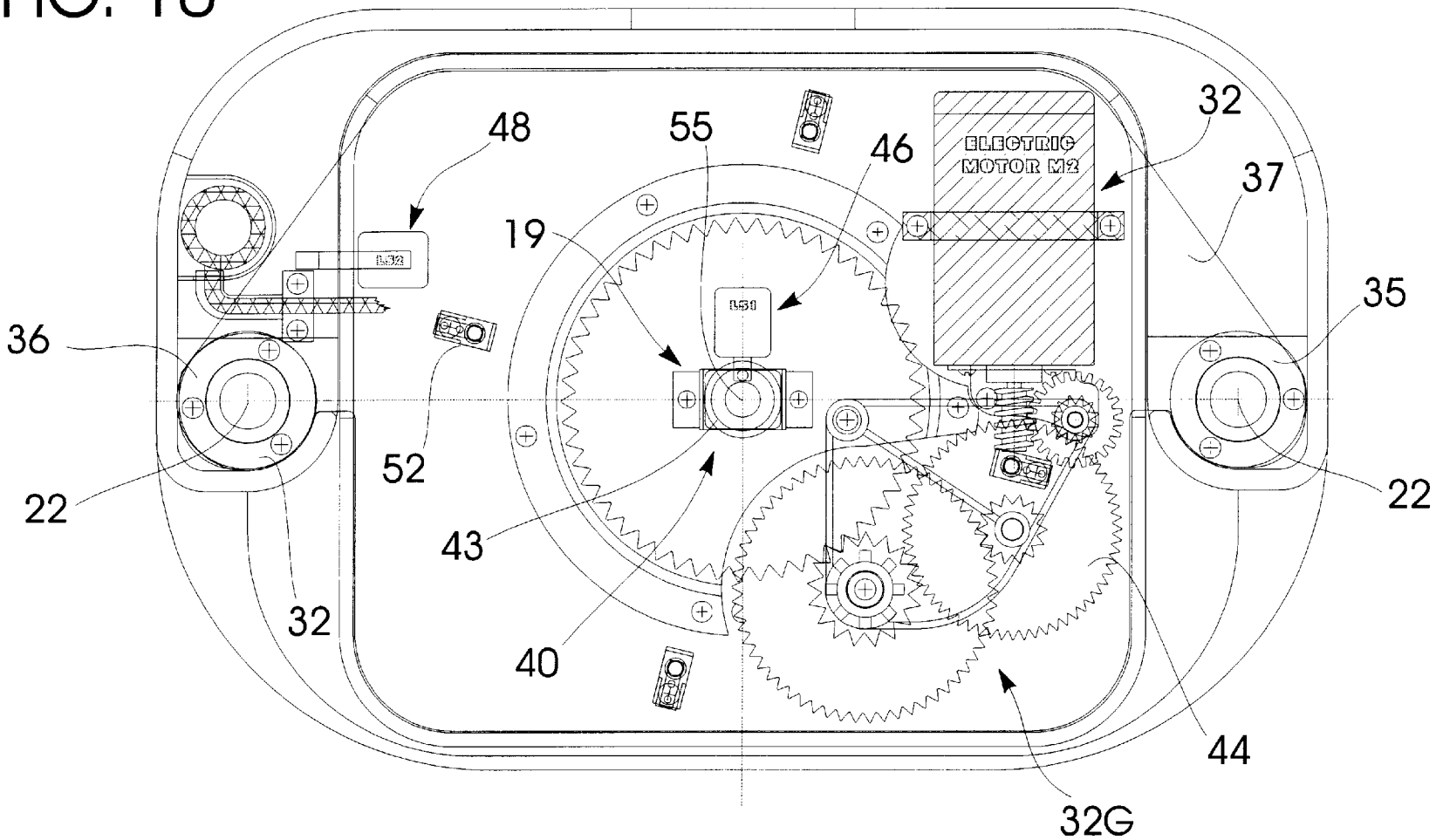
FIG. 10 is an enlarged sectional view taken generally along line 10—10 of FIG. 3; and, FIG. 11 is an enlarged sectional view taken generally along line 11—11 of FIG. 4.

The head 14 is normally disposed in a raised or "home" position, but when activated it may move downwardly and assume the position of FIG. 4. Head movement is vertically perpendicular to the lower friction pad 17. Located within the head 14 is an electric drive motor 32 (FIG. 10) connected through speed reducing gears generally indicated by the reference numeral to 32G (FIG. 10) to a rotatable friction chuck assembly 47. Assembly 47 is partially recessed in the lower side of the head 14. The main drive shaft 43 of the frictional chuck is hollow, thus permitting light beam 19A to be shined through and along its axis. An alternative embodiment of the apparatus employs a self-centering three jaw chuck instead of the friction chuck. A safety stop bar symmetrical to the friction chuck, projects from the lower side of the head housing and functions as an emergency shut down mechanism.

Preferably a laser-generated light aids in the "centering" of the jar. More specifically, a highly visibly, concentrated "spot" produced by an intense, collimated laser light is directed towards the jar center through hollow drive shaft 43. The initial concentric association of jar lid to rotatable axis is critical both to function and safety. The locator light switch 18, which controls electrical current to the light, is preferably located on the top of the head 14. This mounting location is relatively inaccessible to a child.

An "amp pull" indicator 15 may be located on the front face of head 14. This generally rectangular light array is progressively lighted as drive motor amperage increases. The preferred circuitry disconnects power to the friction chuck drive motor in response to excessive drive amperage. The user places the jar, to be opened on the base friction pad 17, taking care to locate the jar lid near the center axis of the apparatus. Because jar lids and jar bodies are not necessarily symmetrical, the location of the center of the jar lid should always control where the jar is positioned.

Figure 1:
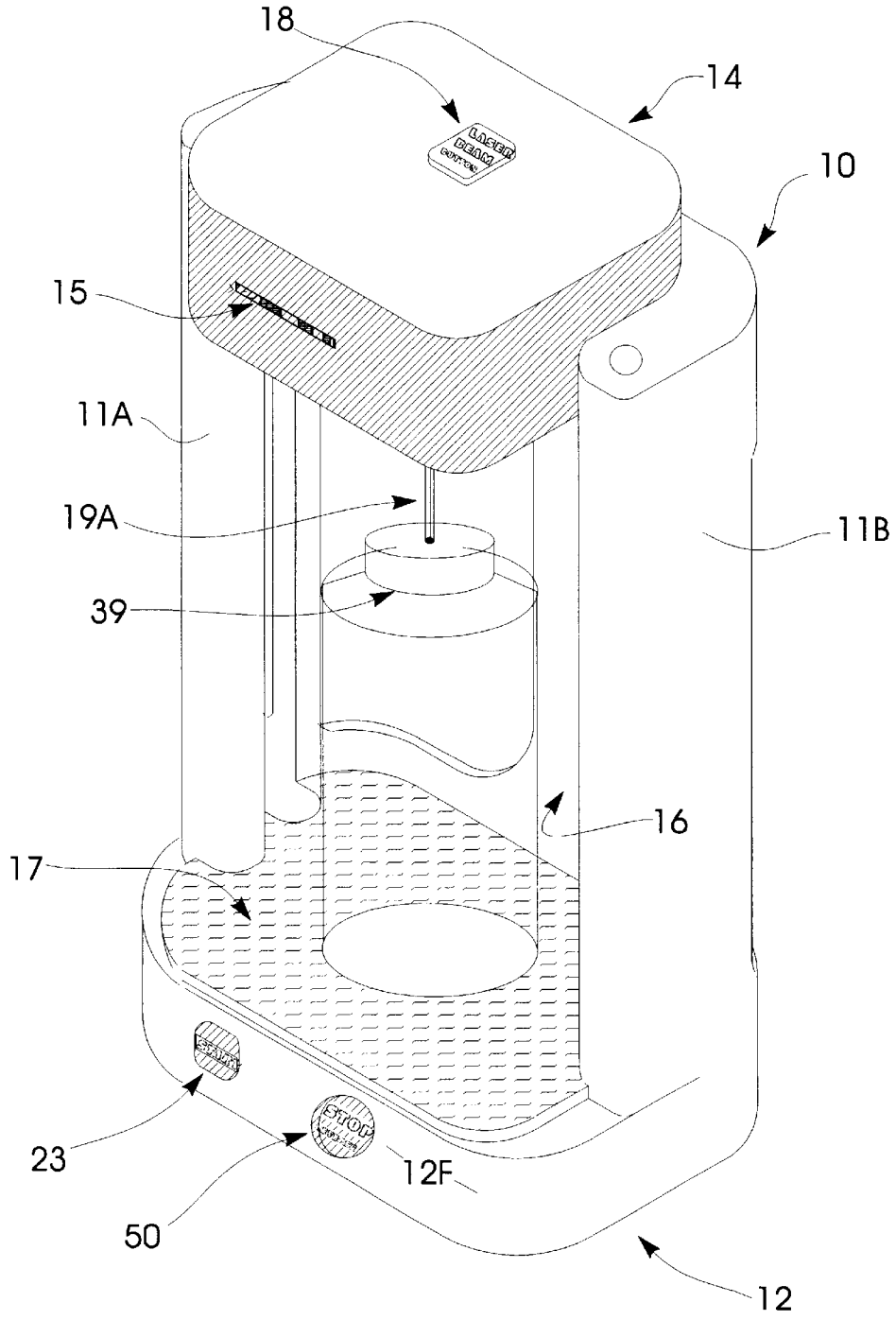
FIG. 1 is a pictorial view of the best mode of my new AUTOMATIC JAR LID OPENER, with a jar to be opened shown in fragmented form.
Figure 2:
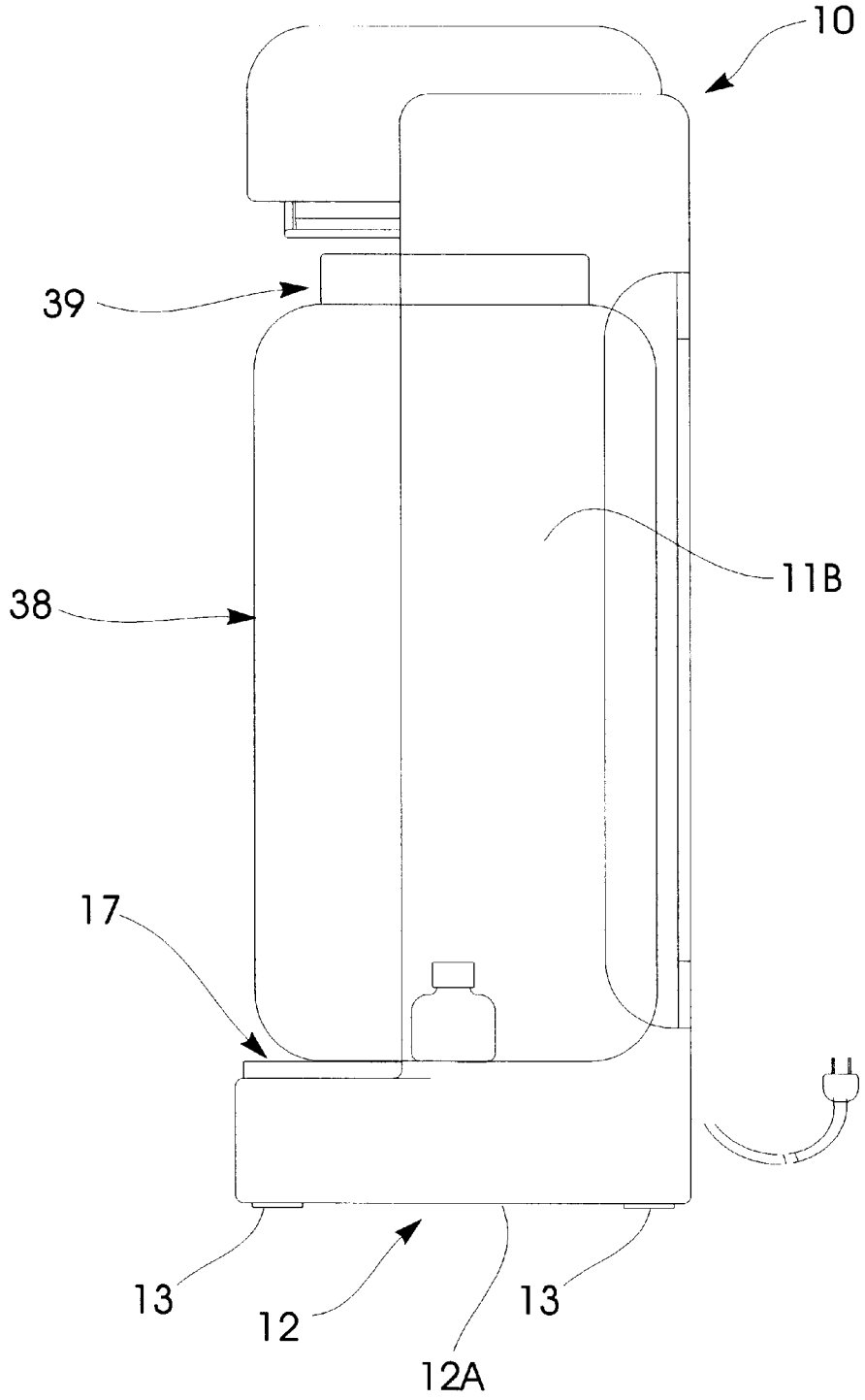
FIG. 2 is a left side elevational view thereof.

Locator light switch 18 (FIG. 1) activates a locator light 19 that projects a light beam 19A (FIG. 1) towards the jar. The jar is manually centered within chamber 16 by aligning the lid center with the laser light beam 19A. The preferred light source 19 is a commercially available, Class III Laser. Other light sources, with or without optical intensifiers, directional beam controls, projected light patterns, or the like will work. The light beam 19A is directed through the hollow chuck drive shaft 43, towards and perpendicular to friction pad 17. Any point along the light beam corresponds to the centerline or axis of the friction chuck 47. During operation, when the head 14 is lowered and/or raised, lateral movement of the head will be controlled by lead screws 20, 21. Slight lateral deviations from the original centerline would be inconsequential. The preferred red light beam has a center spot of approximately ⅛ to ¼ inch diameter. The intensity of the light, is such that, when a lid is placed under the light beam, a spot and luminous ring, or halo, is generated on the surface of the lid. The center spot (with the luminous ring or rings) permits the lid to be easily centered by the user. Various other optical and/or lighting devises may be used to project other geometric patterns onto the jar lid as further centering aids. When a user has centered the jar lid with the light beam, the jar lid may be removed.

The automatic jar opener is activated by pushing start button 23. This energizes the lead screw drive motor 24 (FIG. 11) which is preferably splined to the lead screws 20, 21 by a pinion 25. Drive pinion 25 is externally meshed to spur gear 26 by reduction gear 25R. Spur gear 26 is biased on split drive shaft 27, that supports a worm gear 28, 29 on each end that meshes with worm gears 30, 31 mounted on the bottom end of each lead screw 20, 21. Clockwise rotation of drive motor 24 simultaneously turns both lead screws 20, 21 in a clockwise direction thus pulling the head 14 downwardly toward the friction pad 17. Conversely, with drive motor 24 reversed, both lead screws 20, 21 are turned counterclockwise, thereby elevating the head 14 and moving it upwardly towards its' home position. Drive motor 24 is fractional horsepower, commercially available 6–12 volt reversible motor.

The lead screws 20, 21 comprise elongated, continuously threaded shafts that are machined with bearing journals on both ends. One end of each lead screw 20, 21 accepts a worm gear 30, 31 that is affixed to same by way of a woodruff key and snap ring. The two lead screws 20, 21 pass through internally threaded, flanged nuts 35, 36 that are permanently secured to either side of the head main plate 37. The centerline 22 of the flanged nuts 35, 36 is coincident with a line that intersects the friction chuck axis 55.

The automatic opening cycle begins when start button 23 is pushed. Lead screw drive motor 24 (FIG. 1) is energized, thereby rotating lead screws 20, 21 in a clockwise direction (as seen from base 12). The lead screws 20, 21 pull the head 14 downwardly toward the friction pad 17, on which a jar 38 has been positioned. In the latter instance the lid is concentric with the axis of friction chuck 47. The jar lid 39 will intercept the downward movement of head 14. Specifically, the friction chuck face 42 will contact the jar lid 39. Thus, further vertical travel of the friction chuck 47 will be prevented.

The friction chuck 47 is part of a rotatable assembly 40 recessed in the lower (bottom) side of the head 14. Permanently molded, or affixed, to the lower (external) face of the friction chuck plate 41 is a commercially available frictional material 42 capable of, under pressure, maintaining a secure grasp on screw on type jar lids. The friction chuck plate 41 is attached to the vertically slidable hollow main drive shaft 43 that is coupled by way of reduction gearing 44 to drive motor 32. This rotatable assembly 40 can be moved independently of head 14, vertically along axis 55, approximately 5/16 of an inch. Friction chuck plate 41 is biased by spring 45. Pressure on friction surface 42 (such as from a jar lid) is necessary to move the rotatable assembly 40 from its' home position, within head 14. The hollow main drive shaft 43 can be moved (slide) vertically along axis 55 approximately ¼ inch. Gear 56 is fixed to shaft 43 and moves with the shaft through bearings 57, 58. Once the rotatable assembly 40 has been stopped, by contacting the jar lid 39, head 14 will continue descending for another 1/16 to ⅛" inch, at which point limit switch 46 will be actuated by the upper surface of the hollow main drive shaft 43. The function of limit switch 46 is to deactivate the lead screw drive motor 24 and sequentially activate the friction chuck drive motor 32.

When the frictional chuck face 42 contacts the jar lid 39, the rotatable assembly 40 will give way (stop), and head 14 will continue to descend another 1/16 to ⅛ inch, forcing limit switch 46 to contact the upper surface of the main drive shaft 43. The lead screw drive motor 24 will be shut off, and the frictional chuck drive motor 32 will be activated. This rotates the frictional chuck 47 clockwise (i.e., as viewed from the base 12). The jar 38 and jar lid 39 are yieldably urged towards the respective frictional surfaces 17, 42 and will be held in place as the lid is unscrewed.

Within the head 14, is a commercially available electrical current sensor (i.e., a T/A Sensor) for monitoring torque and amperage (i.e., electrical current) and/or sudden drop-offs occurring in either. If excessive torque/amps or a sudden drop off is detected, the "T/A Sensor" will communicate to the controls that electrical current to the friction chuck drive motor 32 should be turned off. During operation the T/A Sensor monitors the amount of amperage pulled by the friction chuck drive motor 32 to insure maximum design limitations are not exceeded, and interrupts power to the motor if the applied torque exceeds predetermined limits. The T/A Sensor identifies the point at which the electrical current to the motor 32 should be cut off. This point occurs just after the maximum amperage is reached, whereupon drive current levels off momentarily before suddenly dropping. When drive motor 32 is energized, current will elevate rapidly as the rotation of the friction chuck begins. Rotation, however, will be impeded by the resistance of the jar lid 39. Torque applied from drive motor 32 eventually overcomes resistance of the jar lid 39. As increased torque is exerted the drive amperage increases. As the lid 39 starts to turn, drive current will level off momentarily. Once the seal between the jar 38 and jar lid 39 is broken, the amp pull will drop very rapidly. Motor current is sensed by the LED Torque/Amp Indicator that shows how much torque was applied via a lighted array.

Figure 5:
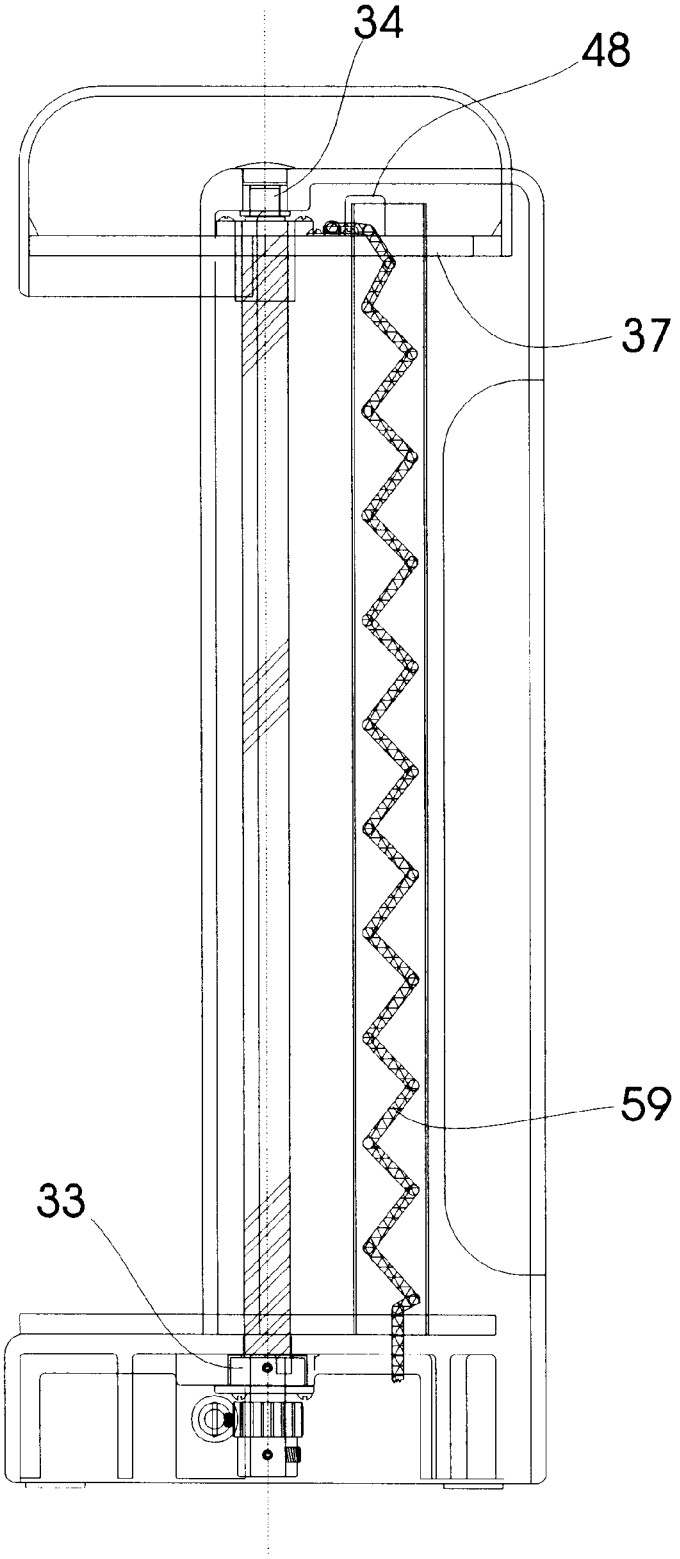
FIG. 5 is a longitudinal sectional view taken generally along line 5—5 of FIG. 3.
Figure 11:
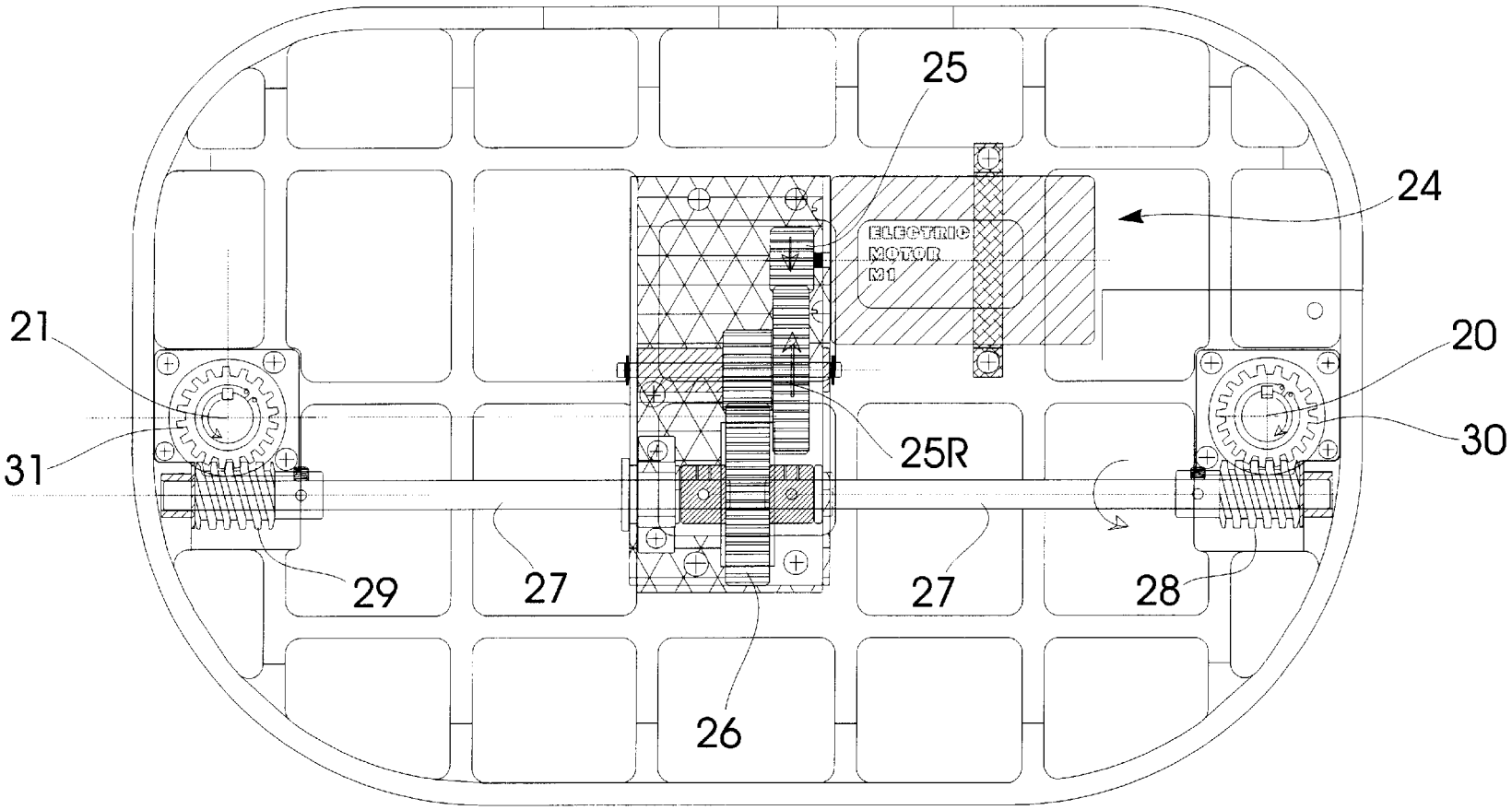

After the deactivation of the chuck drive motor 32 (FIG. 10), lead screw drive motor 24 (FIG. 11) will be reversed, rotating counterclockwise and thereby turning the lead screws 20, 21 in a counterclockwise rotation (FIG. 11). Head 14 will be pushed upwardly to its' home position, actuating limit switch 48 (FIG. 10) which causes the electrical current delivered through cable 59 (FIG. 5) to be interrupted, turning off lead screw drive motor 24. Jar 38 may now be removed from chamber 16. The jar lid 39 will be only partially removed (loosened), to reduce the possibility of spillage. The locator light 19 controlled by the locator light switch 18 must be turned on in order to operate this apparatus. The start button 23 is not functional until the locator light 19 has been turned on, thus preventing someone from accidentally pushing the start button 23 and causing the head 14 to prematurely descend.

The safety stop bar 49 consists of a metal ring that surrounds the friction chuck 47 and protrudes approximately ⅛ inch in front (below) the friction chuck face 42. Bar 49 is attached to the lower side of the head main plate 37 by four or more vertically slidable pins 51 that penetrate into the head cavity. Legs 51 are retained by brackets 52 affixed to the inner (top) side of the head main plate 37.

Figure 6:
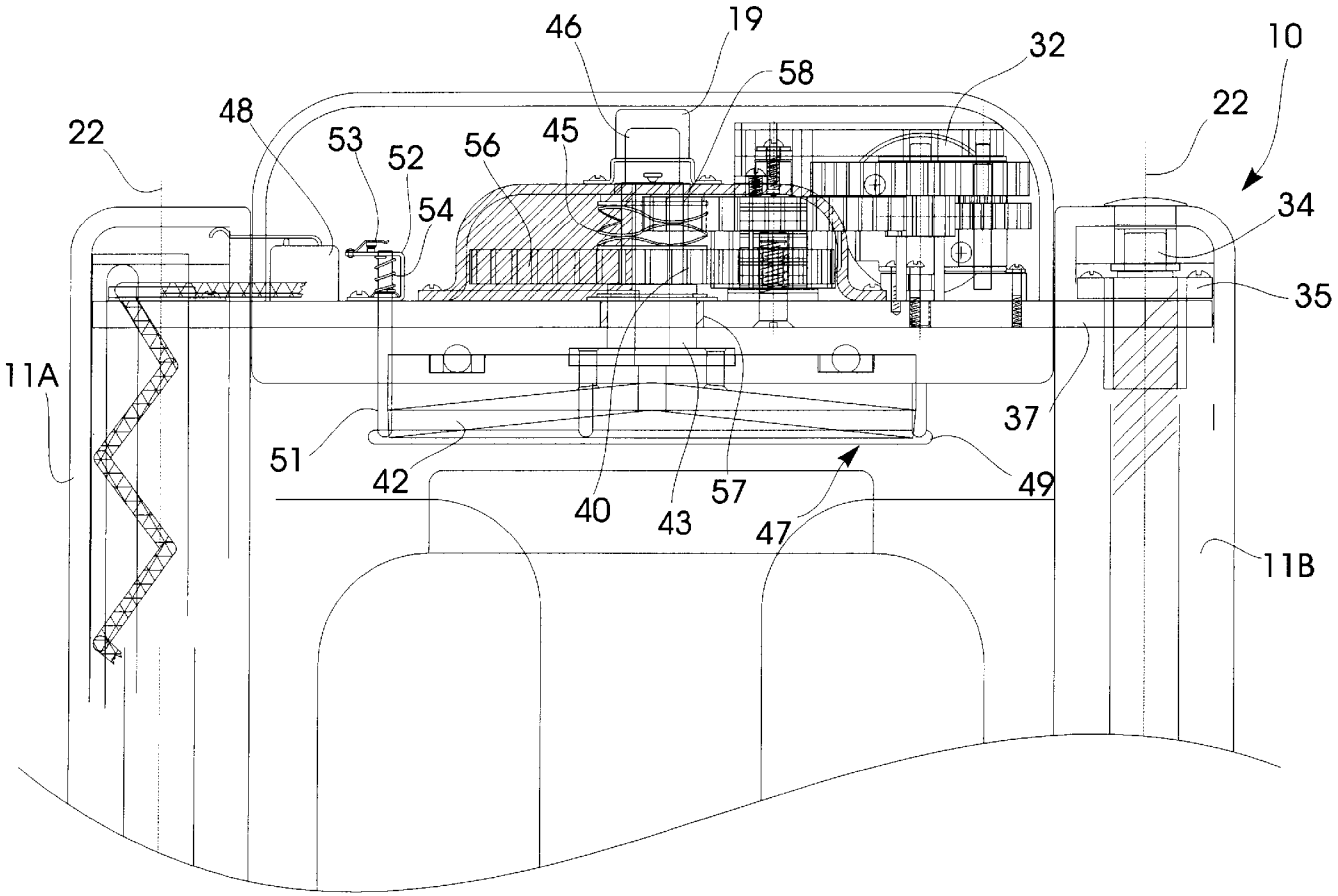
FIG. 6 is a frontal sectional view.
Figure 7:
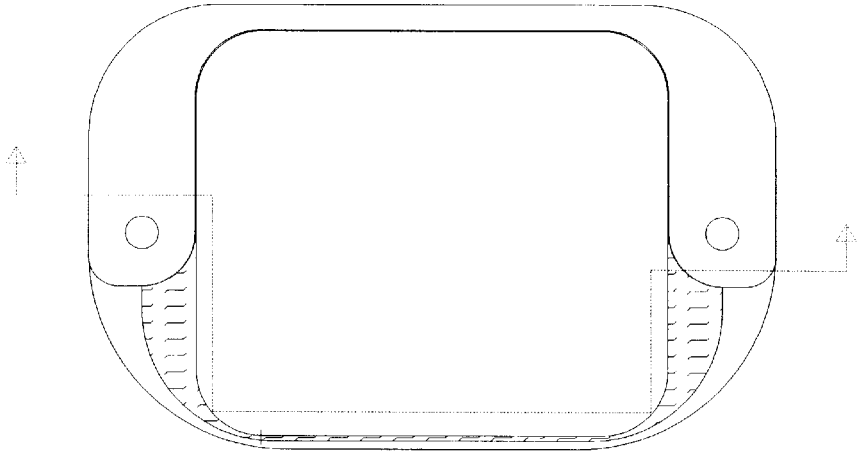
FIG. 7 is a top plan view.
Figure 8:
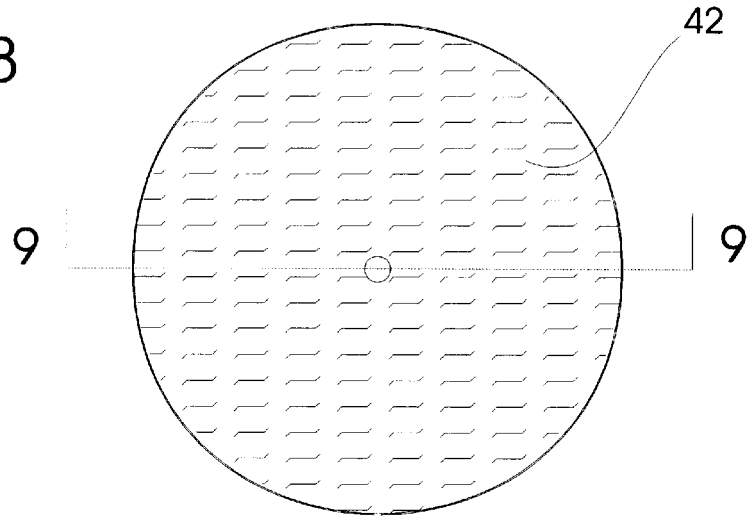
FIG. 8 is a view of the chuck.
Figure 9:
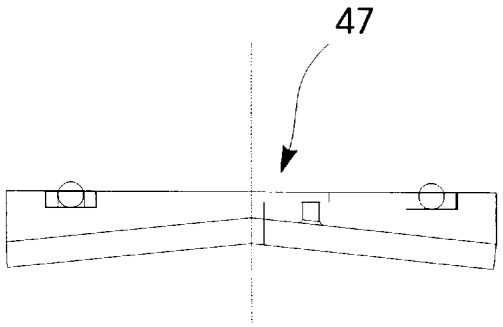
FIG. 9 is a sectional view taken generally along line 9—9 of FIG. 8.

When the safety bar 49 is moved vertically approximately 1/16 inch, the upper end of one or more of pins 51 will come in contact with one or more exposed micro switch spring levers 53 (FIG. 6) that are affixed to the top side of brackets 52. Further upper movement of the spring levers 53 will break a series wired, electric circuit, halting motor 24 and turning off the locator light 19. Spring 54 in each of the brackets 52 will return the safety bar 49 to its' correct position, when the force that initially moved the bar is removed.

After the locator light 19 has been turned on using locator light switch 18, and after button 23 has been pushed, the safety bar 49 is normally activated. Should the safety bar 49 be moved vertically more than 1/16 inch, all movement of the jar lid opener will stop and the locator light 19 will turn off. To restart the jar lid opener, or to elevate the head 14, light 19 and light switch 18 must be activated. The Safety Stop Bar 49 also serves as a downward travel limiter. If there is no jar setting on the friction pad 17, the safety stop bar 49 will contact the friction pad 17, thus shutting off head 14.

If, after head 14 begins to descend towards the jar lid 39, the user sees that the jar 38 is not correctly centered, the user should immediately push the safety stop/reverse button 50. This action will stop the descent of the head 14. A second push of button 50 cause the head 14 to return to the home position, engaging the limit switch 48 and consequently deenergizing light 19. Afterwards the user can properly center the jar 38, and push button 23 again, reactivating head 14.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An automatic container lid remover, said lid remover comprising:

a vertically upright housing adapted to be disposed upon a supporting surface such as a counter top, the housing comprising a lower base, and a spaced apart, movable head normally disposed in a raised position, said head comprising a lower side facing said base;

a chamber defined by said housing between said base and said head for receiving a container to be opened;

a first motor;

means coupled to said first motor for lowering the head into contact with a container to be opened and for raising the head afterwards;

a second motor disposed within said head; and, a friction chuck carried by said head and driven by said second motor for contacting and loosening a container lid to remove it from said container, wherein the friction chuck is disposed proximate said lower side of the head; and, means for shining highly visibly, concentrated light through said chuck towards the container to be opened to aid in proper centering.

2. The container lid remover as defined in claim 1 further comprising a safety stop bar projecting from the housing for emergency stops.

3. The container lid remover as defined in claim 2 further comprising an amp-pull circuit for disconnecting power to the friction chuck drive motor in response to excessive drive amperage.

4. The lid remover as defined in claim 1 further comprising a resilient friction pad secured to said base to prevent a jar from turning during opening.

5. An automatic jar lid remover, said lid remover comprising:

a vertically upright housing adapted to be disposed upon a generally planar supporting surface such as a counter top, the housing comprising a lower base, and a spaced apart, movable head normally disposed in a raised position;

a jar chamber defined by said housing between said head and said base for receiving a jar to be opened;

lead screw means for lowering or raising said head towards or away from said jar;

a lead screw drive motor;

gear means coupling said lead screw drive motor to said lead screw means;

a rotatable friction chuck mounted in said head for contacting a jar to be opened;

a chuck drive motor disposed within said head for rotating the chuck once it contacts a jar;

means for shining highly visibly, concentrated light towards the lid to aid in the centering of the jar to be opened; and, means for establishing an automatic opening sequence.

6. The lid remover as defined in claim 5 wherein said means for establishing an automatic opening sequence comprises:

an electric start button for first energizing said lead screw drive motor to deflect said lead screw means to move the head downwardly;

a limit switch actuated by the head after suitable pressure develops from jar contact for initially deactivating the lead screw drive motor and thereafter activating the friction chuck drive motor;

a sensor for monitoring electrical current through the friction chuck drive motor and disabling said drive motor upon the occurrence of preselected conditions; and, means for returning the head to an upright position after completion of an operating cycle.

7. The lid remover as defined in claim 6 wherein said sensor for monitoring electrical current through the friction chuck drive motor and disabling said drive motor is activated when an excess of current is consumed by said friction chuck drive motor; or torque applied by said friction chuck drive motor exceeds predetermined limits; or, a permissible maximum amperage is reached, followed by a drop of amperage indicating that a jar lid has become loosened.

8. The lid remover as defined in claim 6 further comprising a resilient friction pad secured to said base to prevent a jar from turning during opening.

9. The lid remover as defined in claim 6 wherein the friction chuck comprises a hollow, central drive shaft and said means for shining highly visible light directs light through the hollow drive shaft towards a jar to be opened.

10. The lid remover as defined in claim 9 wherein said means for shining highly visible light comprises a laser light source.

11. The lid remover as defined in claim 6 further comprising a safety stop bar projecting from the housing for emergency stops.

12. An automatic appliance for loosening lids or covers on containers such as jars, said appliance comprising:

a vertically upright housing adapted to be disposed upon a supporting surface such as a counter top, the housing comprising a lower base, and a spaced apart, movable head;

a jar-receptive chamber defined by said housing beneath said head for receiving a jar or container with a lid to be loosened;

means for lowering or raising said head towards or away from said jar;

a rotatable friction chuck mounted in said head for contacting a jar to be opened, said friction chuck comprising a hollow, central drive shaft and laser means for shining light through said shaft to center a container to be opened by projecting highly visibly, concentrated laser light towards the jar or container;

a chuck drive motor disposed within said head for rotating the chuck once it contacts a jar or container; and means for establishing an automatic opening sequence.

13. The appliance as defined in claim 12 wherein said means for establishing an automatic opening sequence comprises:

an electric start button for first energizing said means for lowering or raising said head towards or away from said container to move said friction chuck into engagement with said container;

a limit switch actuated by the head after suitable pressure develops from container contact for initially deactivating the means for lowering or raising said head towards or away from said jar and thereafter activating the chuck drive motor to rotate the lid to be loosened;

a sensor for monitoring electrical current through the chuck drive motor and disabling said drive motor upon the occurrence of preselected conditions; and, means for returning the head to an upright position after completion of an operating cycle.

14. The appliance as defined in claim 13 wherein said sensor for monitoring electrical current through the chuck drive motor disables said drive motor when an excess of current consumed by said chuck drive motor; or, torque applied by said chuck drive motor exceeds predetermined limits; or a permissible maximum amperage is reached, followed by a drop of amperage indicating that a lid has become loosened.

15. The appliance as defined in claim 13 wherein said means for shining light comprises a laser light source that aids in the centering of the jar to be opened by projecting a highly visibly, concentrated light spot towards the jar center.

16. The appliance as defined in claim 13 further comprising a safety stop bar projecting from the housing for emergency stops, and wherein a resilient friction pad is secured to said base to prevent a jar from turning during opening.

* * * * *